US006695303B2

(12) United States Patent
Okada et al.

(10) Patent No.: US 6,695,303 B2
(45) Date of Patent: Feb. 24, 2004

(54) PAPER FEEDER FOR AN IMAGE FORMING APPARATUS

(75) Inventors: Naofumi Okada, Tenri (JP); Shigeki Hayashi, Ikoma-gun (JP); Toyoaki Nanba, Higashiosaka (JP); Jinichi Nagata, Osaka (JP); Toshiki Ogita, Shiki-gun (JP); Kiyoshi Tokishige, Souraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 116 days.

(21) Appl. No.: 10/072,352

(22) Filed: Feb. 6, 2002

(65) Prior Publication Data

US 2002/0130458 A1 Sep. 19, 2002

(30) Foreign Application Priority Data

Mar. 19, 2001 (JP) ..... 2001-078644

(51) Int. Cl.[7] ..... B65H 3/44; B65H 5/26
(52) U.S. Cl. ..... 271/9.12; 271/9.13; 271/164
(58) Field of Search ..... 271/9.12, 9.13, 271/162, 164

(56) References Cited

U.S. PATENT DOCUMENTS 5,405,128 A * 4/1995 Fujiwara et al. ..... 271/9.13
5,573,234 A * 11/1996 Petocchi ..... 271/9.01
5,624,108 A * 4/1997 Kubo ..... 271/9.12
5,988,622 A * 11/1999 Shigeta ..... 271/9.01
6,145,828 A * 11/2000 Arai ..... 271/3.03

FOREIGN PATENT DOCUMENTS

JP 06-100191 4/1994
JP 06263276 A * 9/1994 ..... B65H/3/44
JP 10-194486 7/1998

* cited by examiner

*Primary Examiner*—Christopher P. Ellis
*Assistant Examiner*—Mark A. Deuble
(74) *Attorney, Agent, or Firm*—Renner, Otto, Boisselle & Sklar, LLP

(57) ABSTRACT

A paper feeder includes: a multiple number of paper feed cassettes arranged abreast at approximately the same level in the sheet feed direction. These paper feed cassettes are formed into a unibody structure so that they can be pulled out altogether. The more upstream a paper feed cassette is located with respect to the sheet feed direction, the higher the level of the upper surface of the paper feed cassette is arranged. This arrangement affords a space over the downstream paper feed cassette, in which a feed path for recording paper picked up from a paper feed cassette located on the upstream side can be arranged.

13 Claims, 8 Drawing Sheets

PAPER FEEDER FOR AN IMAGE FORMING APPARATUS

BACKGROUND OF THE INVENTION (1) Field of the Invention

The present invention relates to a paper feeder built in an image forming apparatus such as a copier, printer, facsimile machine or the like. In particular, the present invention relates to an improvement of a paper feeder having a multiple number of paper feed cassettes arranged abreast at the same level.

(2) Description of the Prior Art

Conventionally, with concern to image forming apparatus such as copiers, printers facsimile machines and multifunctional machines consisting of these, there has been a demand of reducing the footprint of the apparatus to as small as possible. To meet this demand, so-called vertical feed type image forming apparatus have become widespread, in which paper is fed from the paper feed cassette arranged at the bottom of the image forming apparatus and conveyed along the paper feed path laid out vertically to the paper output tray located at the top.

Concerning the image forming apparatus of this type, there is also another demand for reducing the frequency of paper loading task by increasing the capacity of the stored amount of paper of sizes, which are frequently used (e.g., A4 size paper, etc.). To meet this demand, a paper feeder arrangement has been known as disclosed in Japanese Patent Application Laid-Open Hei 10 No. 194486, for example, in which a multiple number of paper feed cassettes of an identical size are arranged abreast at the same level.

Now, this paper feeder arrangement will be described. As shown in FIG. 1 (a side view showing an outline of the paper feeder arrangement), the paper feeder arrangement of this kind has a pair of paper feed cassettes a and b for paper of an identical size, arranged abreast at the same level. One paper feed cassette, designated at a, is located on the upstream side, the other paper feed cassette, designated at b, is located on the downstream side. A pickup roller c with a pair of feed rollers d is disposed on the paper delivery side of each of paper feed cassettes a and b. Formed over the downstream side paper feed cassette b is a paper delivery path f for delivering a sheet picked up from upstream side paper feed cassette a to paper feed path e. As one example of operation of this paper feed arrangement, upon image forming, sheets of paper are successively delivered first from the downstream side paper feed cassette b toward the image forming station, and when the paper in the downstream side paper feed cassette b is used up, the paper feed operation is shifted to the upstream side paper feed cassette a. In this way, the stored amount of paper of a size which is frequently used is increased so that the frequency of the paper loading task can be reduced.

In the paper feeder arrangement disclosed in the above publication, the upstream and downstream side paper cassettes g and h are adapted to be pulled out individually, as shown in FIGS. 2A to 2C while the paper pickup path, designated at j, formed over the downstream side paper feed cassette h and upstream side paper feed cassette g are adapted to be pulled out integrally (see FIGS. 2B and 2C). In actual practice, when paper needs to be supplied to the downstream side paper feed cassette h or when paper jamming of a sheet delivered from this downstream side paper feed cassette h has occurred, the downstream side paper feed cassette h should be drawn out. On the other hand, when paper needs to be supplied to the upstream side paper feed cassette g or when paper jamming of a sheet delivered from the upstream side paper feed cassette g has occurred, the upstream side paper feed cassette g should be drawn out.

However, in the above paper feeder arrangement, both the upstream and downstream side paper feed cassettes need to be supplied with paper, it is necessary to pull out each of the paper feed cassettes individually. Particularly, in the configuration where paper feed is taken over from one cassette to another when the paper in the first paper feed cassette has been used up, paper loading task is usually carried out at the same time for both the paper feed cassettes. Though there has been a demand for paper loading to be done at the same time for both the paper feed cassettes, each paper feed cassette has to be drawn out individually, so that the task of paper loading has been complicated and time-consuming.

SUMMARY OF THE INVENTION

The present invention has been devised in view of the above problems and it is therefore an object of the present invention to provide improvement in the operativity of paper loading in to each cassette of the paper feeder having multiple paper feed cassettes which are arranged abreast along the sheet feed direction at the same level.

In order to attain the above object, the present invention is configured so that the multiple paper feed cassettes arranged abreast are formed into a unibody structure and can be drawn out altogether from the image forming apparatus when they are pulled out.

In order to achieve the above object, the present invention is configured as follows:

In accordance with the first aspect of the present invention, a paper feeder which is provided for an image forming apparatus having image forming means for forming an image on a sheet and feeds sheets to the image forming means, the paper feeder includes: a multiple number of paper feed cassettes arranged abreast at approximately the same level in the sheet feed direction, the paper feed cassettes being formed into a unibody structure so that they can be pulled out altogether from the feeder body; and feed paths formed over the feed cassettes excepting the one located on the most upstream side with respect to the sheet feed direction, for conveying sheets supplied from the paper feed cassettes located on the upstream side of each cassette, and is characterized in that the feed path is adapted to make wider the gap thereof when the paper cassettes are pulled out, so as to allow a sheet stuck therein to be removed therefrom.

In accordance with the second aspect of the present invention, the paper feeder for use in an image forming apparatus having the above first feature is characterized in that the upper surfaces of the paper feed cassettes are arranged rising stepwise from the paper feed cassette located on the most downstream side toward the paper feed cassette located on the most upstream side with respect to the sheet feed direction.

In accordance with the third aspect of the present invention, the paper feeder for use in an image forming apparatus having the above first feature is characterized in that the feed path is formed by a pair of upper and lower guide plates and the lower guide plate is moved downwards so as to make wider the gap thereof.

In accordance with the fourth aspect of the present invention, the paper feeder for use in an image forming apparatus having the above third feature is characterized in that the level of the upper guide plate is set to be approximately equal to the upper edge of the cassette storage opening of the feeder body when the paper feed cassettes have been pulled out.

In accordance with the fifth aspect of the present invention, the paper feeder for use in an image forming apparatus having the above third feature is characterized in that the lower guide plate is pivotally supported at one end located on the interior side of the feeder body with respect to the direction of the paper feed cassettes being pulled out, and the gap of the paper feed path is made wider by rotating the lower guide plate downward about the pivot, and the rotational movement of the lower guide plate is achieved in linkage with the paper feed cassettes being pulled out from the feeder body and being pushed into the feeder body.

In accordance with the sixth aspect of the present invention, the paper feeder for use in an image forming apparatus having the above third feature is characterized in that when the paper feed cassettes have been pushed into the feeder body, the upper surface of the associated paper feed cassette abuts the underside of the lower guide plate so as to position the lower guide plate at a designated level that defines the feed path in cooperation with the upper guide plate.

In accordance with the seventh aspect of the present invention, the paper feeder for use in an image forming apparatus having the above sixth feature is characterized in that an abutment member that abuts the upper surface of the associated paper feed cassette is provided on the underside of the lower guide plate, and this abutment member has a surface inclined upward in the direction of the paper feed cassettes being pulled out when the lower guide plate is positioned at the designated level that forms the feed path in cooperation with the upper guide plate.

In accordance with the eighth aspect of the present invention, the paper feeder for use in an image forming apparatus having the above first feature is characterized in that each paper feed cassette has a pickup unit for picking up sheets from the paper feed cassette, and this pickup unit is comprised of a pickup roller for picking up one sheet from the paper feed cassette and a pair of feed rollers for delivering the sheet separated by the pickup roller to the image forming means.

In accordance with the ninth aspect of the present invention, the paper feeder for use in an image forming apparatus having the above eighth feature is characterized in that the pickup unit has bearing plates for supporting the pickup roller and paired feed rollers at their shaft ends in a rotatable manner.

In accordance with the tenth aspect of the present invention, the paper feeder for use in an image forming apparatus having the above eighth feature is characterized in that the pickup unit is able to pivot on an axis parallel to the axial direction of the pickup roller and paired feed rollers, so that the pickup unit can be moved between a first position where the pickup roller comes in contact with the sheet in the paper feed cassette and a second position where the pickup unit is removed from the top opening of the paper feed cassette.

In accordance with the eleventh aspect of the present invention, the paper feeder for use in an image forming apparatus having the above tenth feature is characterized in that the pickup unit is configured so as to rotate from the second position to the first position in linkage with the paper feed cassettes being pushed into the feeder body.

In accordance with the twelfth aspect of the present invention, the paper feeder for use in an image forming apparatus having the above eleventh feature is characterized in that the pickup unit has a projection that abuts a guide element formed on the feeder body and rotates the pickup unit from the second position to the first position when the paper feed cassettes are inserted into the feeder body.

In accordance with the thirteenth aspect of the present invention, the paper feeder for use in an image forming apparatus having the above twelfth feature is characterized in that the guide element has a surface inclined downward toward the side to which the paper feed cassette is pushed in, and the pickup unit is rotated from the second position to the first position whilst the projection is being guided by the inclined surface.

According to the configuration of the present invention, since paper feed cassettes are provided in a unibody structure, the paper feed cassettes can be pulled out altogether from the paper feeder body when sheets need to be supplied to each paper feed cassette. Therefore, it is possible to load sheets at the same time to all the paper feed cassettes in this pulled out position. Since feed paths of sheets delivered from paper feed cassettes located upstream are formed over the paper feed cassettes located downstream by making the upper level of each paper feed cassette different from others, the feed path can be formed straightly and approximately horizontally from the sheet pickup position of the paper feed cassette, which leads to smooth pickup of sheets from the paper feed cassette.

The invention is configured so that when a sheet has stuck in the feed path (when paper jam has occurred), the sheet can be readily removed. That is, the gap of the feed path can become wider upon removal of a sheet when paper jam has occurred in the feed path. Therefore it is possible for an operator to readily remove the sheet which has stuck therein.

According to the present invention, it is possible to spread the gap of the feed path with a relatively simple configuration.

According to the present invention, since the lower guide plate can also be positioned as high as possible, it is possible to secure a large enough margin for the lower guide plate to move down. More explicitly, it is possible to take a large enough space to remove the sheet being stuck in the feed path, which provides easier sheet removal.

Further, according to the present invention, since the device for actuating the lower guide plate to move vertically is so configured that the front side of the lower guide plate moves downwards so as to make wider the gap between the upper and lower guide plates when the paper feed cassettes are simply pulled out from the feeder body. That is, the feed path can be spread open to the user who pulls out the paper feed cassettes. In this way, since the gap between the guide plates can become wider when the paper feed cassettes have been pulled out, no special actuation for shifting the lower guide plate downward is needed, hence this provides beneficial operativity. Further, the lower guide plate returns to the original position in linkage with the insertion of the paper feed cassettes.

According to the present invention, a simple operation of pushing the paper feed cassettes into the feeder body causes the lower guide plate to return to its original position so that it creates the designated feed path in cooperation with the upper guide plate. Therefore, after the paper feed cassettes are pulled out in order to cancel paper jamming, this feature makes it possible for the image forming apparatus to smoothly recover its function after cancellation of paper jamming.

In the present invention, the guide mechanism for shifting the lower guide plate is configured so that when the paper feed cassette begins to be pulled out, the lower guide plate gradually moves down whilst the inclined surface of the abutment member is sliding over the upper surface of the paper feed cassette. When the paper feed cassette is fully drawn out, the lower guide plate has moved down to the lowest position. In contrast, when the paper feed cassette is pushed in, the lower guide plate gradually moves up whilst the inclined surface of the abutment member is sliding over the upper surface of the paper feed cassette, in the reverse order when the cassette is pulled out. When the paper feed cassette is pushed in completely, the lower guide plate is positioned at the predetermined feed path forming level that creates the feed path in cooperation with the upper guide plate.

In the present invention, the arrangement for picking up sheets from the paper feed cassettes is configured so that all the pickup units are pulled out integrally with the paper feed cassettes when paper feed cassettes are pulled out from the feeder body. Therefore, when paper jam has occurred at the pickup roller or at the paired feed rollers, the jammed sheet can be markedly easily removed from the image forming apparatus by drawing out the paper feed cassette.

According to the configuration of the present invention, if the pickup roller needs to be put into contact with the stack of sheets held in the paper feed cassette with a predetermined pressure applied thereto, it is possible to apply the necessary contact force of the pickup roller onto the sheet by exerting an appropriate urging force on the bearing plate. Thus, a relatively simple configuration makes it possible to adapt the pickup roller to produce a desired contact force.

According to the present invention, when sheets are loaded into the paper feed cassettes, the pickup rollers can be removed from the top openings of the paper feed cassettes by rotating the pickup units to their second positions. Therefore, this movement enlarges the open area of the top opening, thus enabling easy sheet loading.

According to the arrangement for returning the rotated pickup unit to its original position, the pickup unit can be returned to its original position (the first position) by mere insertion of the paper feed cassettes into the feeder body. Therefore, it is possible for the image forming apparatus to smoothly recover its function after paper loading.

Furthermore, according to the present invention, the pickup unit which has been rotated at the second position can be returned by rotating to the first position by abutment of the projection of the pickup unit against the guide element whilst the paper feed cassettes are being inserted into the feeder body.

Therefore, when the pickup unit returns to the first position, it is possible to reduce the impacts when this pickup unit interferes with other components, hence it is possible to prevent the pickup unit from being broken and reduce the impact sound. Further, the rotational speed of the pickup unit can be made relatively slow, so that noise accompanying the rotation can be inhibited.

DESCRIPTION OF THE PREFERRED EMBODIMENTS

The embodiment of the present invention will hereinafter be described in detail with reference to the accompanying drawings.

Figure 1:
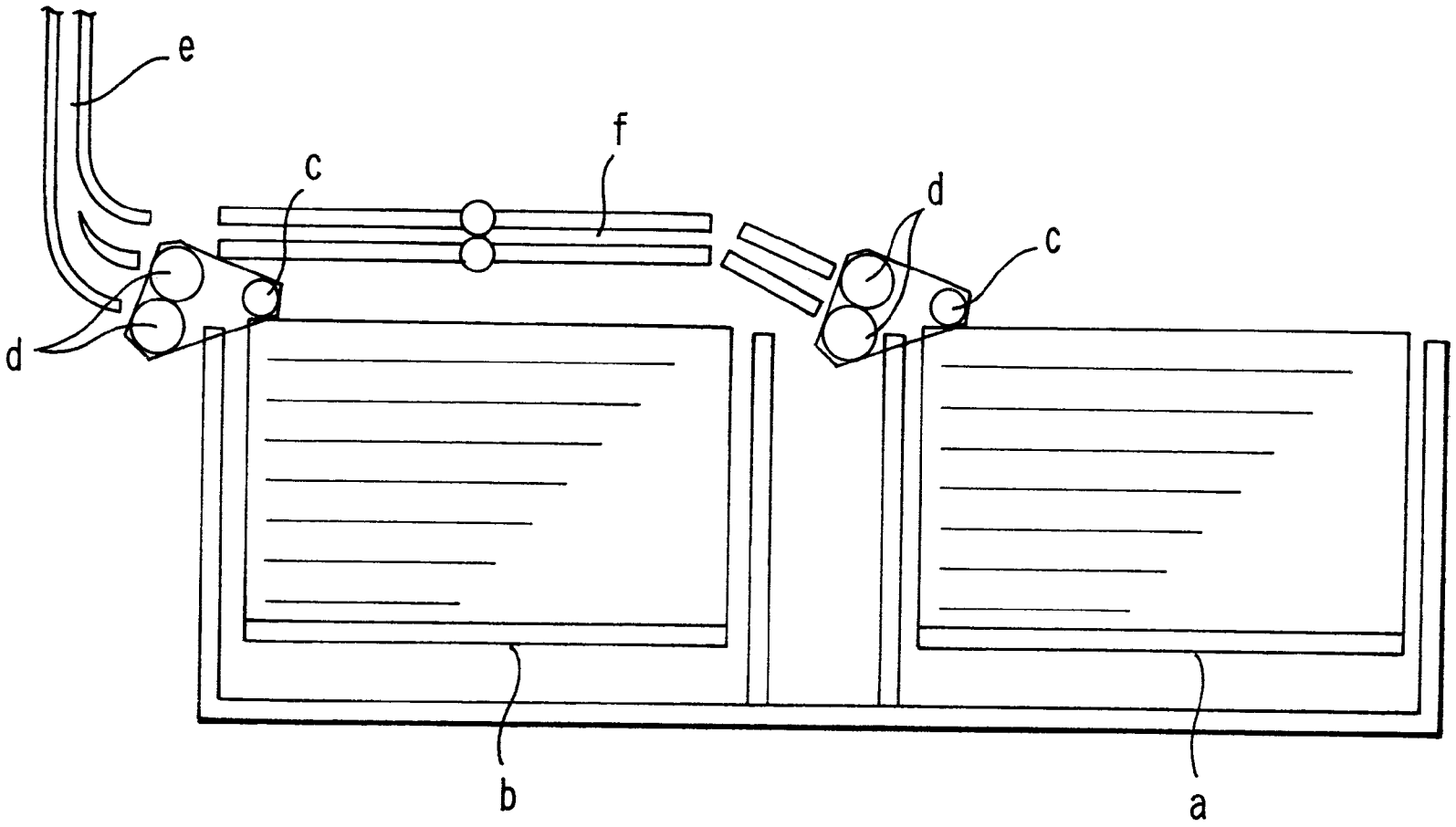
FIG. 1 PRIOR ART
FIG. 1 is a side view showing a conventional configuration comparable to FIG. 4.
Figure 2A:
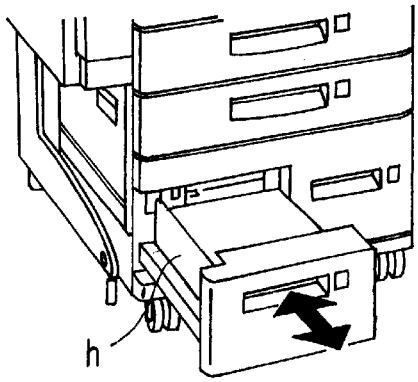
FIG. 2A PRIOR ART
FIGS. 2A to 2C are illustrative views showing the overall configuration of paper loading in the conventional paper feeder, FIG. 2A showing the way of paper loading to the downstream side paper feed cassette, FIG. 2B showing the way of paper loading to the upstream side paper feed cassette, FIG. 2C showing the way of cancellation of paper jam in the feed path.
Figure 2B:
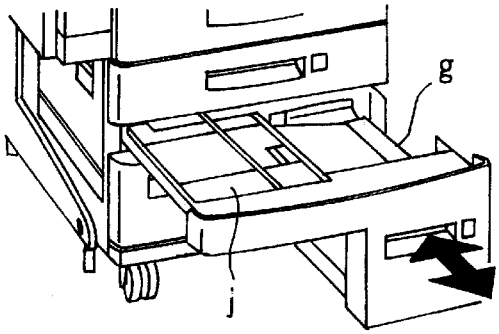
FIG. 2B PRIOR ART
Figure 2C:
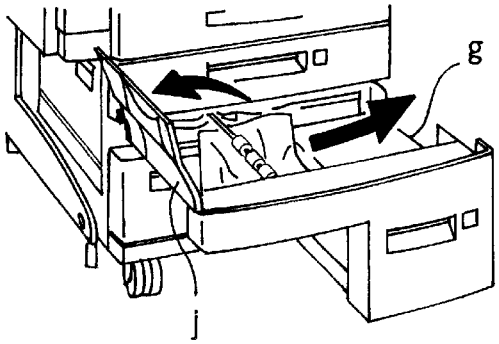
FIG. 2C PRIOR ART
Figure 3:
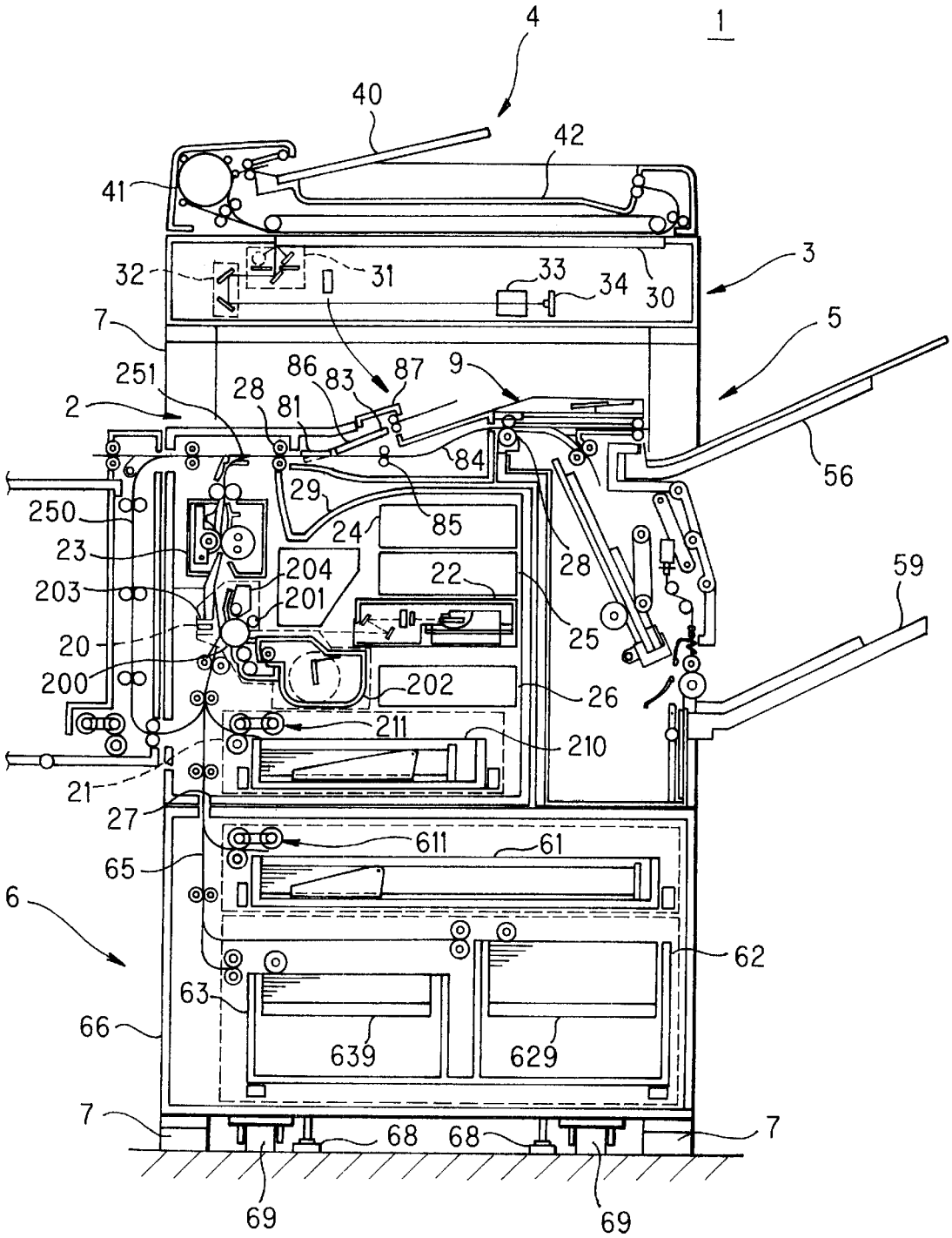
FIG. 3 is a schematic structural view showing the interior of an image forming apparatus according to the embodiment.

FIG. 3 is a schematic structural view showing the interior of an image forming apparatus 1 according to this embodiment. This image forming apparatus 1 is a multifunctional type having the functions of a copier, printing machine and facsimile machine combined. This image forming apparatus 1 comprises a printer 2, scanner 3, automatic document feeder 4, paper discharge unit 5 and multi-layered paper feeder 6. The configuration of each part will be described next.

Automatic document feeder 4 has a document feeder mechanism 41, by which documents set on a document set tray 40 are successively fed to and positioned on a glass platen 30 so that the image of each document is scanned by scanner 3 and then conveyed and discharged to a document output tray 42. Further, in order to allow a document incapable of being fed to be placed on glass platen 30, the automatic document feeder 4 is hinged on its one side (on the interior side in FIG. 3) so that feeder 4 can be totally opened and closed.

Scanner 3 can be selectively operated either in automatic scan mode or manual scan mode. When the former or automatic scan mode is selected, scanner 3 scans the images of originals in linkage with the conveyance of the documents onto glass platen 30 by automatic document feeder 4. When the latter or manual scan mode is selected, the image of the original placed on glass platen 30 is scanned in response to a manual actuation. In either mode, first and second scan units 31 and 32 are caused to move keeping the predetermined velocity relationship between the units so that the original placed on glass platen 30 is illuminated by first scan unit 31 and the reflected light from the original is introduced to a lens 33 by way of first and second scan units 31 and 32 so that the original image is focused on a photoelectric transducer (CCD) 34 by lens 33. This CCD 34 is configured to scan the original image successively line-wise in the main scan direction and output image data in accordance with the original image.

Printer 2 receives image data from scanner 3 or image data from an external unit (e.g., a personal computer) and records the images represented by the image data onto recording paper.

A printer controller 24 provided in this printer 2 controls an electrophotographic processing unit 20 as an image forming means and has the function of an interface for receiving image data from external units. An image controller 25 subjects the image data from external units to predetermined image processes and implements drive control of optical scanning unit 22 in accordance with the image data.

Electrophotographic processing unit 20 is comprised of a photoconductor drum 200, charging roller 201, optical scanning unit 22, developer unit 202, transfer unit 203, cleaning unit 204 and erasure unit (not shown). Photoconductor drum 200 rotates in one direction. Charging roller 201 uniformly electrifies the photoconductor drum 200 surface. Optical scanning unit 22 produces a light beam (light image) modulated in accordance with image data and repeatedly scans the light beam in the main scan direction over the photoconductor drum 200 surface so as to form an electrostatic latent image on the photoconductor drum 200 surface. Developer unit 202 supplies the photoconductor drum 200 surface with toner. The toner is attracted to the static latent image on the photoconductor drum surface 200, forming a toner image. Transfer unit 203 places the recording paper conveyed from below over photoconductor drum 200 so as to transfer the toner image from photoconductor drum 200 to the recording paper. Cleaning unit 204 removes the toner left over on the photoconductor drum 200 surface. Erasure unit removes the electric charge from the photoconductor drum 200 surface.

Arranged above electrophotographic processing unit 20 is a fixing unit 23. Fixing unit 23 fixes the toner image onto the recording paper by heating and pressing the recording paper. The recording paper with the toner image thus fixed is conveyed by discharge rollers 28 to be passed to an intermediary path unit 8 in paper discharge unit 5.

When another image is formed on the underside of the recording paper, conveyance of the recording paper is halted, and the recording paper is conveyed in reverse from intermediary path unit 8 to printer 2. In printer 2, a branch control claw 251 is rotated so that it leads the recording paper into an inverting feed path 250, through which the recording paper is fed again to electrophotographic processing unit 20, whereby the recording paper is turned upside down and another image is recorded on the underside of the recording paper. The recording paper with images printed on both sides is conveyed by discharge rollers 28 and passed to intermediary path unit 8 in the paper discharge unit 5.

Arranged under printer 2 is a paper feed portion 21. This paper feed portion 21 has a paper storage cassette 210 for storing a stack of recording sheets and a pickup unit 211 for separating and picking up the recording paper, sheet by sheet, from paper storage cassette 210 to deliver it to electrophotographic processing unit 20. The recording paper thus picked up by this pickup unit 211 is passed through transfer unit 203 and fixing unit 23 and conveyed by discharge rollers 28. This paper storage cassette 210 is adapted to be pulled out from the image forming apparatus body and can be charged with recording paper when it is pulled out.

Paper discharge unit 5 has intermediary path unit 8 and post-processing unit 9 and is an optional unit so can be removed from image forming apparatus 1.

Intermediary path unit 8 is comprised of an intermediary path 84 for receiving recording paper from printer 2 and conveying it to post-processing unit 9, a switchback path 83 for temporarily receiving the recording paper from printer 2 and returning it to printer 2 and a gate plate 81 for leading the recording paper from printer 2 either to intermediary path 84 or switchback path 83. Gate plate 81 is pivotable and leads recording paper to intermediary path 84 when its distal end is turned upwards and leads recording paper to switchback path 83 when its distal end is turned downwards.

Intermediary path 84 has a pair of feed rollers 85 rotating in one direction so that these feed rollers 85 lead recording paper to post-processing unit 9. Switchback path 83 includes a placement plate 86 for holding recording paper thereon and a pair of feed rollers 87 capable of rotating in forward and reverse directions. Other than the feed rollers 87, other feed rollers 28 are also capable of rotating in forward and reverse directions. When recording paper is led into switchback path 83, the paper is conveyed until it is set on placement plate 86 with its rear end held between feed rollers 28 of printer 2 and the conveyance of the recording paper is halted at that position by halting rotation feed rollers 87 and 28. Then, feed rollers 87 and 28 rotate in reverse so as to convey the recording paper into printer 2 with its rear end forward. In printer 2, the recording paper is led by branch control claw 251 into inverting feed path 250 as stated already, passing through inverting feed path 250, and is conveyed to electrophotographic process station 20, where another image is recorded on the underside of the recording paper.

Post-processing unit 9 receives the recording paper through intermediary path 84 from printer 2 and implements necessary post processes. Examples of the post processes include stapling and sorting. The recording paper after post processing is discharged to one of paper output trays 56 and 59.

The above printer 2 and paper discharge unit 5 are mounted on the top of multi-layered paper feeder 6. Scanner 3 and automatic document feeder 4 are mounted on a system rack 7. Attached under multi-layered paper feeder 6 are casters 69 and fixture feet 68. When fixture feet 68 are screwed into the bottom of multi-layered paper feeder 6 so that multi-layered paper feeder 6 rests on casters 69 with fixture feet 68 away from the floor surface, the multi-layered paper feeder 6 is set to be movable. In this state, multi-layered paper feeder 6 with printer 2 and paper discharge unit 5 is moved and placed inside system rack 7. Thereafter, fixture feet 68 are unscrewed so as to bring each fixture foot 68 into contact with floor surface to thereby fix the multi-layered paper feeder 6. In this position, a space is created between intermediary path unit 8 of paper discharge unit 5 and scanner 3.

The multi-layered paper feeder 6 is an optional component so it can be removed from image forming apparatus 1. This multi-layered paper feeder 6 has a plurality of paper storage cassettes 61, 62 and 63 for holding multiple types of recording paper. In the multi-layered paper feeder 6 of this embodiment, an upper cassette 61 capable of holding relatively large-sized recording sheets (e.g., A3 size) is arranged at a higher position while a pair of lower cassettes 62 and 63 capable of holding recording sheets of a frequently used size (e.g., A4 size) are arranged side by side under the upper cassette 61.

A paper guide path 65 extending vertically is arranged inside multi-layered paper feeder 6 so that recording paper picked up from any of cassettes 61, 62 and 63 is supplied to printer 2 by way of this paper guide path 65. This printer 2 has a paper entry port 27 formed at the bottom thereof at a position corresponding to paper guide path 65 so that the recording paper having passed through paper guide path 65 enters printer 2 through paper entry port 27.

Arranged on the paper discharge side of the upper cassette 61 (on the left side in the drawing) is a pickup unit 611. This pickup unit 611 separates and picks up the recording paper stored in upper cassette 61, sheet by sheet, so as to send it out to electrophotographic processing unit 20 by way of paper guide path 65 and paper entry port 27. This upper cassette 61 can be pulled out from the paper feeder frame as the multi-layered paper feeder body, designated at 66, to the front side in the drawing and can be charged with recording paper when it is pulled out.

Figure 4:
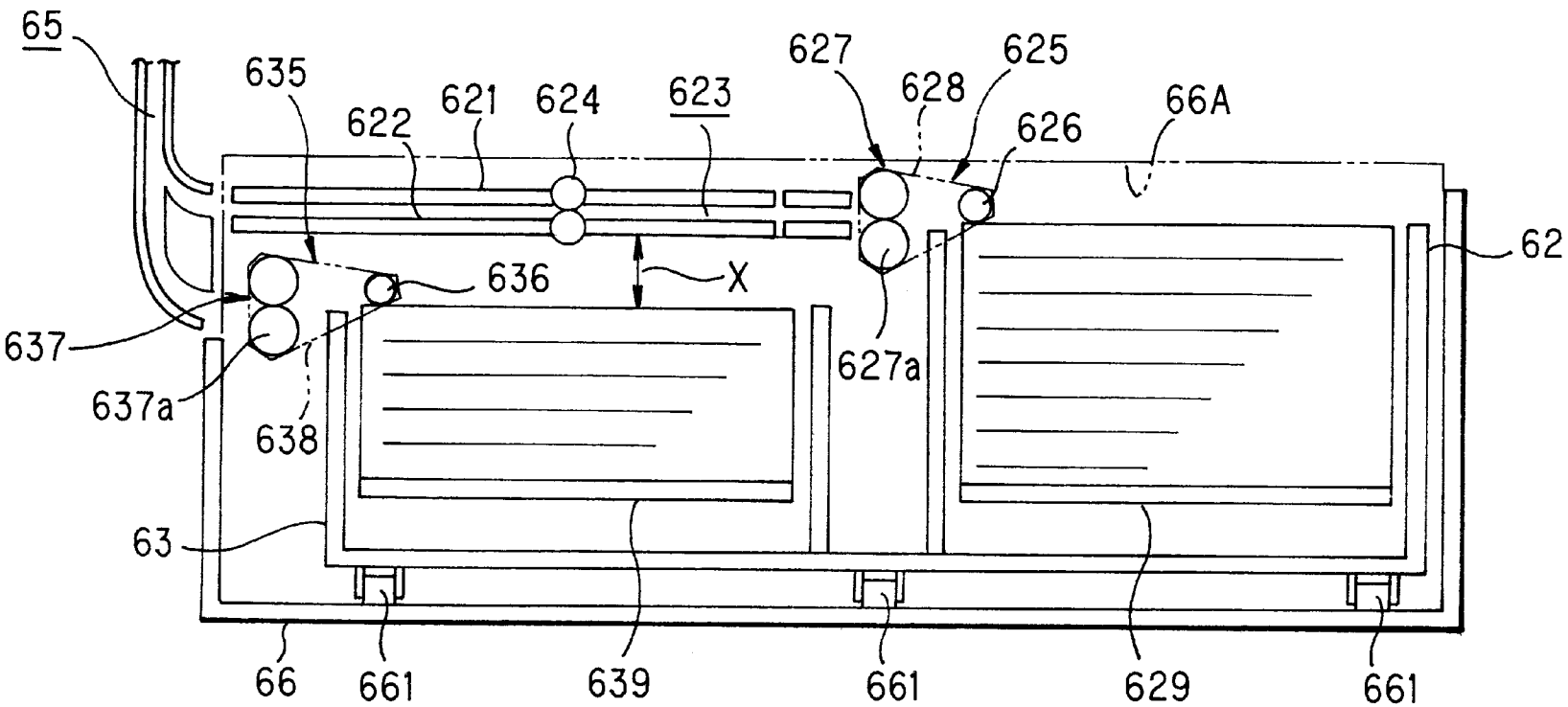
FIG. 4 is a sectional side view showing the lower cassettes and their peripheral arrangement.

The main feature of this embodiment resides in the arrangement of lower cassettes 62 and 63 and their peripheral parts. The configuration of lower cassettes 62 and 63 and their peripheral parts will be described next. As shown in FIG. 4, lower cassettes 62 and 63 are composed of the first cassette 62 located on the right side in the drawing (the upstream side with respect to the recording paper feed direction) and the second cassette 63 located on the left side in the drawing (the downstream side with respect to the recording paper feed direction). These cassettes 62 and 63 are formed integrally and can be slid along drawer rails 661 on paper feeder frame 66 in the direction perpendicular to the document of FIG. 4. Illustratively, cassettes 62 and 63 are adapted to be pulled out altogether from paper feeder frame 66 when paper needs to be loaded or when paper jamming has occurred.

Further, as one aspect of these cassettes 62 and 63, the upper surface of first cassette 62 is set higher to some degree than the upper surface of second cassette 63. In other words, the upper surfaces of cassettes 62 and 63 are different in level. The space above second cassette 63 is utilized to form the feed path of recording sheets picked up from first cassette 62. Detailedly, a pair of upper and lower guide plates 621 and 622 are arranged opposing each other in the space above this second cassette 63. The space between these guide plates 621 and 622 constitutes a feed path 623 for the recording paper. The downstream end (the left-hand end in the drawing) of this feed path 623 is connected to the aforementioned paper guide path 65. A pair of feed rollers 624 are arranged in this paper path 623 so as to guide the recording sheet picked up from first cassette 62 toward paper guide path 65.

Figure 5:
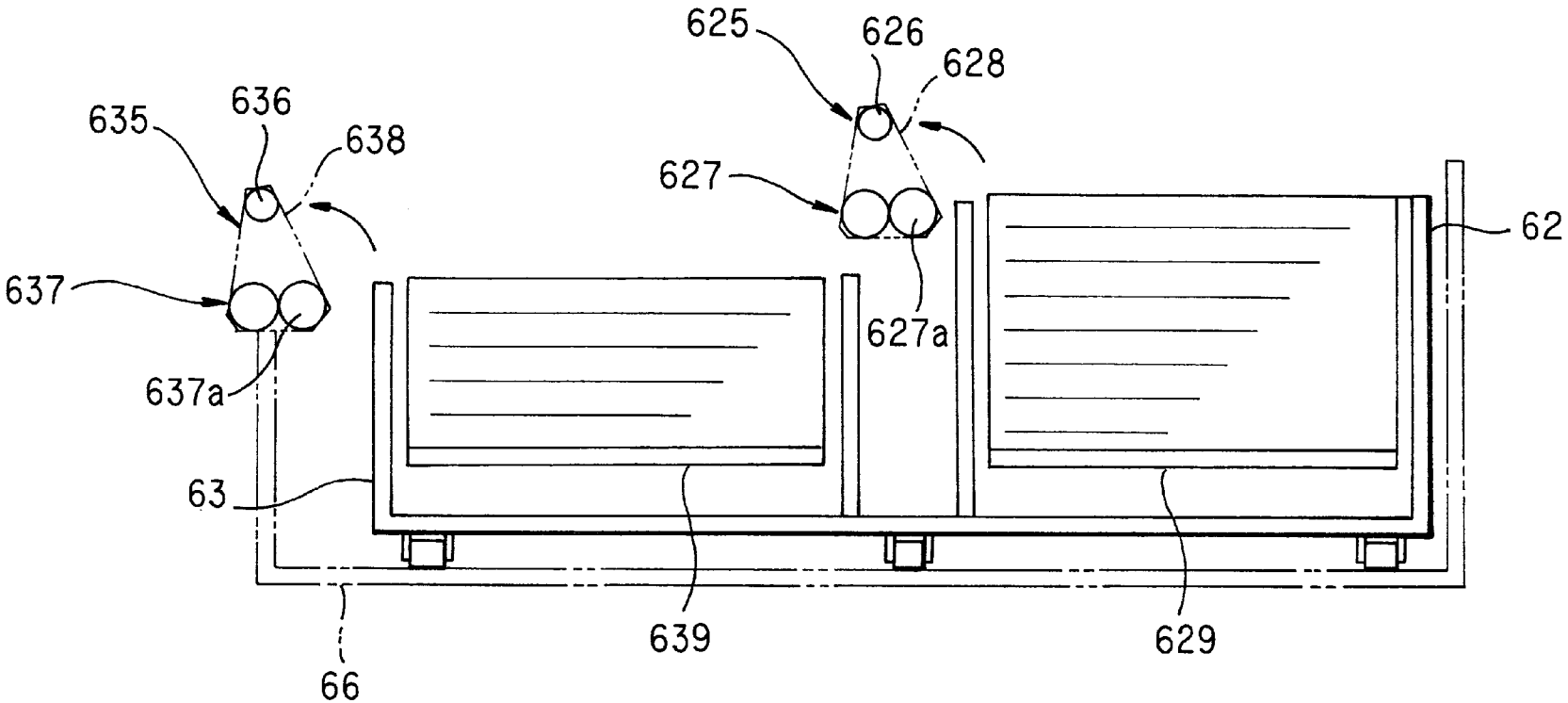
FIG. 5 is a sectional side view showing pickup units in their second positions, comparable to FIG. 4.
Figure 6:
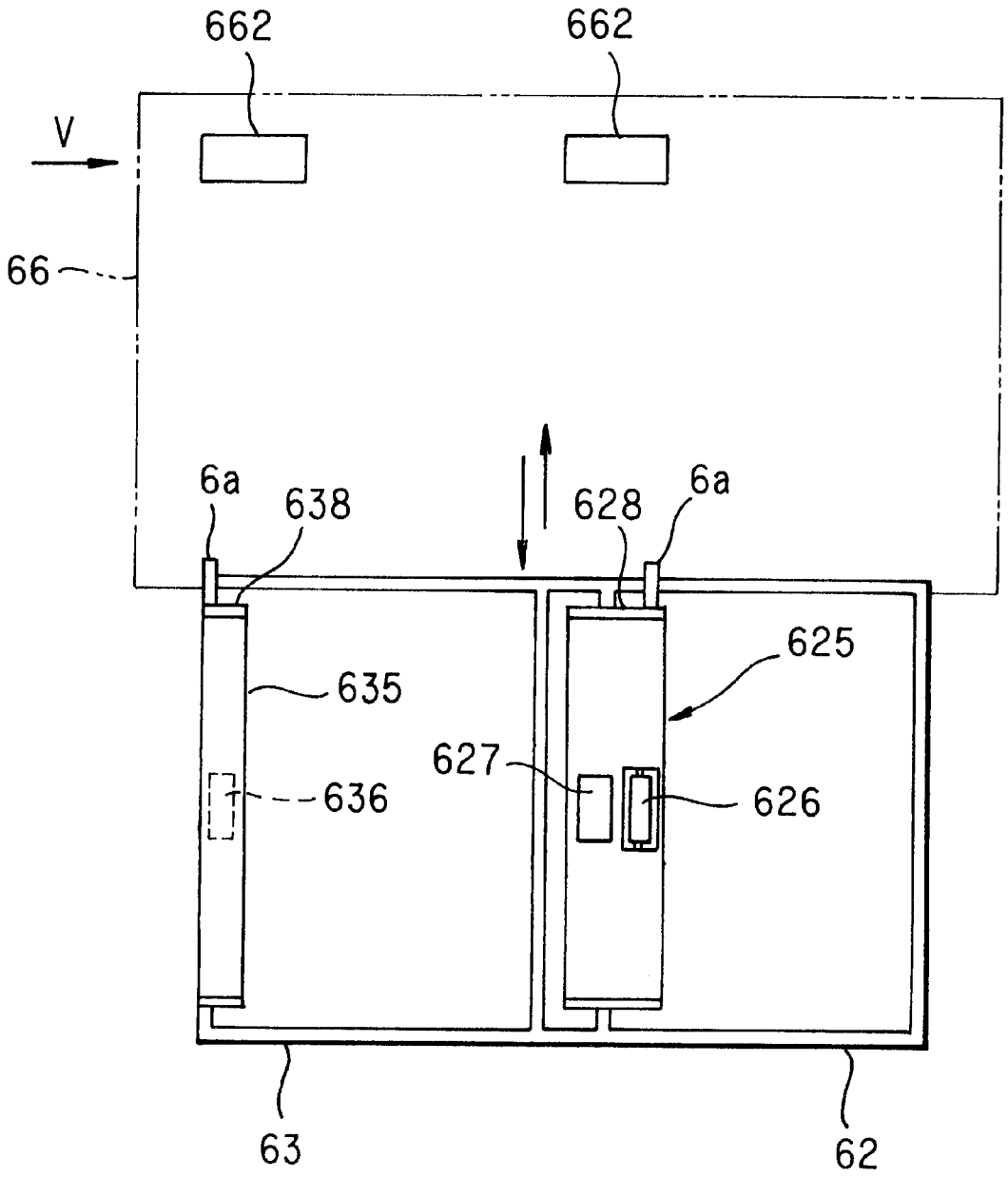
FIG. 6 is a plan view showing the schematic configuration of the lower cassettes and their peripheral parts.

Cassettes 62 and 63 have respective pickup units 625 and 635, similar to the upper cassette 61. This pickup unit 625(635) is composed of a pickup roller 626(636) for picking up a sheet from cassette 62(63) and a pair of rollers 627(637) for sending out a single sheet picked up by the pickup roller 626(636) toward paper guide path 65. This pickup roller 626(636) and paired feed rollers 627(637) are rotationally supported at both ends by bearing plates 628 (638). Further, this bearing plates 628(638) are rotatably supported on cassette 62(63) about the axis of a lower roller 627*a*(637*a*), one of the pair of upper and lower rollers constituting feed roller pair 627(637). Illustratively, when bearing plate 628(638) is rotated clockwise in the drawing, pickup unit 625(635) is set into the first position shown in FIG. 4 so that pickup roller 626(636) comes into contact with the topmost recording sheet in cassette 62(63) so as to enable pickup of this recording sheet. In contrast, when the bearing plate 628(638) is rotated counterclockwise in the drawing, pickup unit 625(635) is set into the second position shown in FIG. 5 so that pickup roller 626(636) is removed from the top opening of cassette 62(63). This retraction of pickup roller 626(636) assures the necessary opening area of the top opening of cassette 62(63), thus facilitating paper loading from the top. FIG. 6 is a plan view showing a state where lower cassettes 62 and 63 have been pulled out from paper feeder frame 66. In this drawing, pickup unit 625 of first cassette 62 is set at the first position while pickup unit 635 of second cassette 63 is set at the second position.

Rotation of each of pickup units 625 and 635 from the first to second position is effected by the user's manual operation. More specifically, when cassettes 62 and 63 need to be charged with sheets, cassettes 62 and 63 are pulled out first from paper feeder frame 66. In this state, pickup unit 625(635) is rotated from the first to the second position by manual action so as to secure a large opening area for the top opening of cassette 62(63). In this condition, paper loading task is implemented.

Figure 7A:
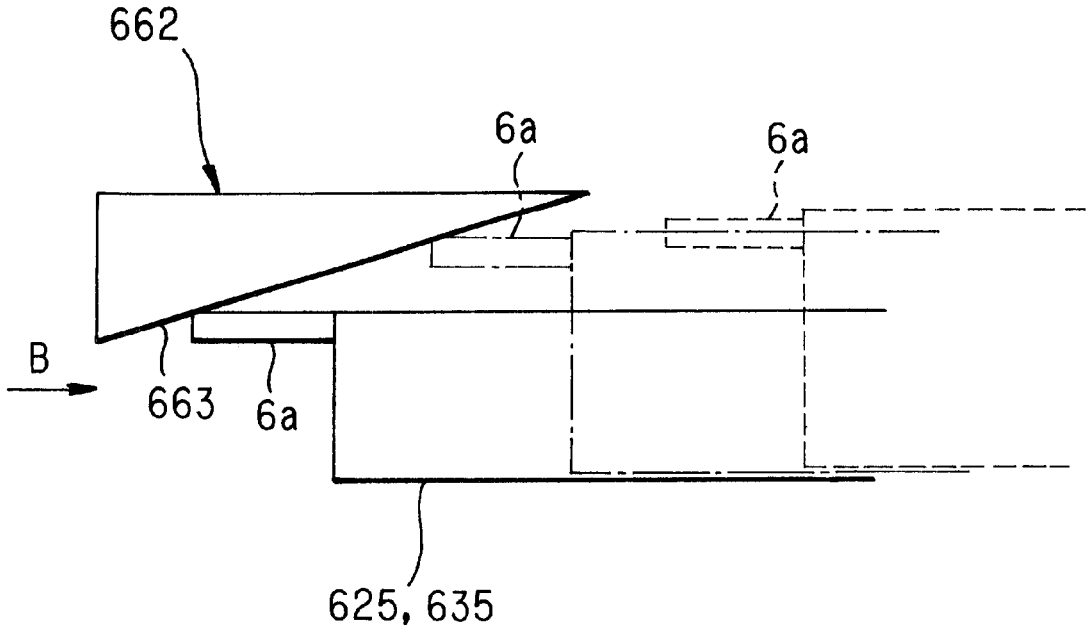
FIGS. 7A and 7B are views for illustrating the rotational movement of each pickup unit when the lower cassettes are inserted, FIG. 7A being a view from the direction along the arrow V in FIG. 6, FIG. 7B being a view from the direction along the arrow B in FIG. 7A.
Figure 7B:
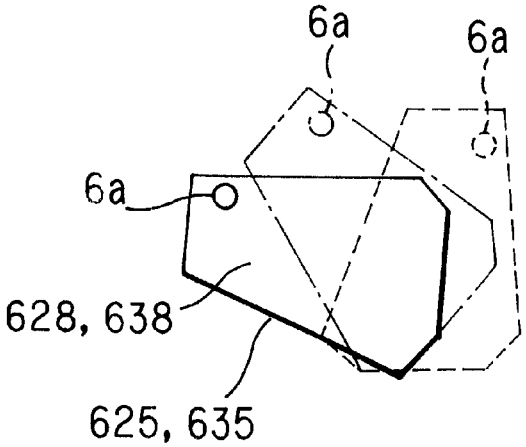

The movement of pickup unit 625(635) from the second to first position is made in linkage with the inserting action of cassettes 62 and 63 into paper feeder frame 66. The mechanism for this linkage will be described next. As shown in FIG. 6, each of the bearing plates 628 and 638 on the interior side (on the upper side in the drawing) of pickup units 625 and 635 is integrally formed with a projected rod 6*a* extending horizontally from the end face thereof while paper feeder frame 66 is formed with a pair of guide elements 662 on the interior side thereof at the positions corresponding to these rods 6*a* and 6*a*. Each guide element 662 has an underside 663 which is inclined as shown in FIG. 7A. This inclined surface 663 is so formed that it goes downwards towards the interior of paper feeder frame 66. Therefore, when cassette 62(63) is inserted into paper feeder frame 66, rod 6*a* abuts inclined surface 663 of this guide element 662 and is guided by the inclined surface 663 as cassette 62(63) is pushed in so that pickup unit 625(635) is rotated downwards being set into the first position. FIGS. 7A and 7B are views showing the rotational movement of pickup unit 625(635), FIG. 7A being a view from the direction along the arrow V in FIG. 6, FIG. 7B being a view from the direction along the arrow B in FIG. 7A. In these drawings, upon insertion of cassette 62(63), the dotted line indicates a state where rod 6*a* does not yet abut inclined surface 663 of guide element 662; the chain line indicates the state where rod 6*a* abuts inclined surface 663 of guide element 662 and pickup unit 625(635) starts rotating downwards; and the solid line indicates the state where cassette 62(63) has been pushed in place and pickup unit 625(635) is set into the first position.

Set plates 629 and 639 for supporting stacks of recording paper in cassettes 62 and 63 and are constructed so as to be moved up and down by unillustrated paper lifting mechanisms. This paper lifting mechanism is configured so that the set plate 629(639) moves to the lowest position when cassette 62(63) is pulled out from paper feeder frame 66 so as to allow for paper loading into cassette 62(63). When cassette 62(63) is set into paper feeder frame 66 after paper loading, set plate 629(639) is moved up by the paper lifting mechanism until the topmost recording sheet comes into contact with pickup roller 626(636).

Another feature of this embodiment resides in the lower guide plate 622, one of the pair of upper and lower guide plates 621 and 622 that define feed path 623 over second cassette 63, is configured so as to move up and down. Next, the lifting mechanism of this lower guide plate 622 will be described.

Figure 8A:
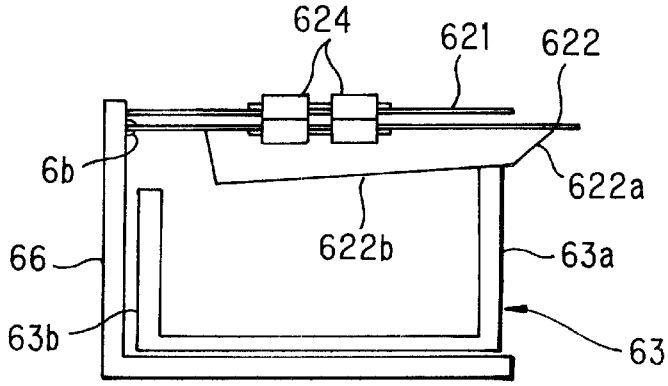
FIGS. 8A to 8C are views for illustrating the rotational movement of the lower guide plate.
Figure 8B:
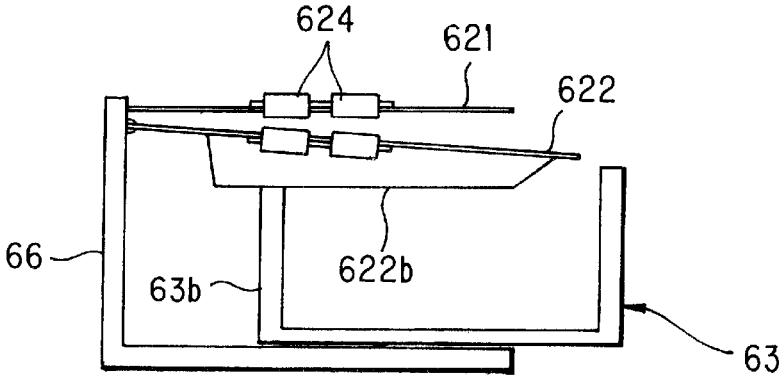
Figure 8C:
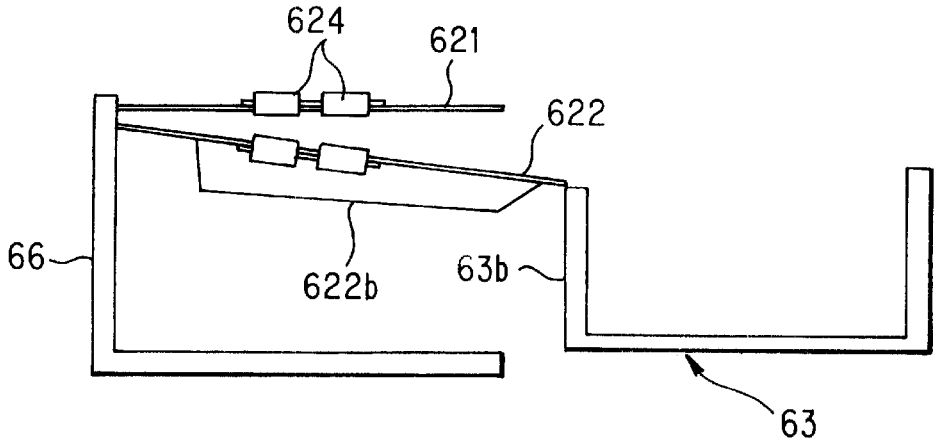

As shown in FIGS. 8A to 8C, lower guide plate 622 is pivotally supported about a horizontal axis by paper feed frame 66. Detailedly, among the four sides of lower guide plate 622 of a substantially rectangular shape when viewed from top, the side on the upstream side with respect to the direction of the cassette being pulled out, or the left-hand side in FIGS. 8A to 8C is pivotally supported by a hinge mechanism 6*b*. Formed on the underside of lower guide plate 622 is an abutment member 622*a* which abuts against, and hence is restrained by, the upper surface of second cassette 63. This abutment member 622*a* has an inclined surface 622*b*, which is slightly inclined upward toward the direction of second cassette 63 being pulled out in the state shown in FIG. 8A (in the state where lower guide plate 622 is set at a level so as to form the designated feed path). Among the upper end faces of second cassette 63, the upper end face of the front wall, designated at 63*a*, located on the side facing the direction of pulling out, is adapted to abut underside 622*b* of abutment member 622*a* so as to position the lower guide plate 622 at a level forming the designated feed path, in the state shown in FIG. 8A. On the other hand, among the upper end faces of second cassette 63, the upper end face of the rear wall, designated at 63*b*, located on the side opposite to the direction of pulling out, is formed so as to be slightly lower than the upper end face of front wall 63*a*. Therefore, when cassettes 62 and 63 start to be pulled out, the upper end face of front wall 63*a* of second cassette 63 becomes away from lower guide plate 622 and the upper end face of rear wall 63*b* of second cassette 63 instead, abuts underside 622*b* of abutment member 622*a* of lower guide plate 622 so as to support the lower guide plate 622. Since underside 622*b* of abutment member 622*a* is formed of an inclined surface, the greater cassettes 62 and 63 are pulled out, the more the lower guide plate 622 rotates downwards (see FIGS. 8B and 8C). This rotation makes wider the gap between upper and lower guide plates 621 and 622 so as to allow for easy removal of a sheet when the sheet has jammed in this area.

In the present embodiment, the level of upper guide plate 621 is set at approximately the same level to, or slightly lower than, the upper edge of the cassette storage opening, designated at 66A and indicated by an imaginary line in FIG. 4, of paper feeder frame 66 when cassettes 62 and 63 are pulled out. This arrangement makes it possible to position lower guide plate 622 as high as possible, to thereby allow this lower guide plate 622 to move down a large distance. More explicitly, it is possible to obtain a large enough space to remove a sheet when lower guide plate 622 is shifted downwards.

When cassettes 62 and 63 are pushed into paper feeder frame 66 after cancellation of paper jamming, the upper end face of rear wall 63*b* of second cassette 63 abuts underside 622*b* of abutment member 622*a* so as to rotate lower guide plate 622 upwards. Thereafter, when cassettes 62 and 63 have been inserted completely, the upper end face of front wall 63*a* of second cassette 63 restrains the lower guide plate 622 at the predetermined feed path forming level (at the position shown in FIG. 8A) so as to create feed path 623 between this lower guide plate 622 and upper guide plate 621.

As has been described, in the present embodiment, since paper cassettes 62 and 63 arranged side by side are integrated, these paper feed cassettes 62 and 63 can be pulled out altogether from paper feeder frame 66. Therefore, loading of paper into these paper feed cassettes 62 and 63 can be performed together, so that it is possible to improve the operativity of the paper loading task.

Further, feed path 623 is formed in the space over second cassette 63, and the guide plates 621 and 622 which constitute this feed path 623 are configured so as to remain within paper feeder frame 66 when paper feed cassettes 62 and 63 are pulled out from paper feeder frame 66. On the contrary, in the conventional configuration disclosed in the above-mentioned publication (Japanese Patent Application Laid-Open Hei 10 No. 194486), when both cassettes are pulled out, the components constituting the feed path spread over the downstream paper feed cassette. Therefore, it is impossible to load the paper to the downstream paper feed cassette in such a state. That is, loading of paper to the downstream paper feed cassette cannot be performed unless the upstream paper feed cassette has been pushed in. In contrast, in paper feeder 6 of this embodiment there is no obstruction over the top openings of pulled out cassettes 62 and 63, hence this also makes easy and smooth paper loading into paper feed cassettes 62 and 63 possible. Since pickup rollers 626 and 636 can be removed from the top openings of cassettes 62 and 63 by rotating pickup units 625 and 635, this rotation makes it possible to enlarge the top openings, thus further facilitating paper loading into paper feed cassettes 62 and 63.

Since lower guide plate 622 moves down in linkage with paper feed cassettes 62 and 63 being pulled out so as to spread feed path 623, when paper jam has occurred in this feed path 623 the paper can be removed easily, whereby it is possible to improve the operativity.

Since the height of second cassette 63 located on the downstream side is designed to be lower the height of first cassette 62, it is possible to secure a relatively large space (the distance X in FIG. 4) between second cassette 63 and lower guide plate 622. This also contributes to making removal of jammed paper easy.

In addition, since pickup units 625 and 635 are configured so as to return to their original positions in linkage with insertion of paper feed cassettes 62 and 63, this makes it possible for the image forming apparatus to smoothly recover its function after paper loading.

The above embodiment of the present invention was described taking an application example of a paper feeder with two cassettes arranged side by side along the feed direction of recording paper. However, the present invention should not be limited to this and can be applied to a paper feeder in which three or more cassettes are arranged abreast along the feed direction of recording paper.

In the embodiment of the present invention, the mechanism for spreading the inner space of feed path 623 is constructed by causing lower guide plate 622 to move down. However, the present invention should not be limited to this. Spreading of the inner space of feed path 623 may be carried out by causing the upper guide plate 621 to move up or by causing the guide plates 621 and 622 to move in the directions opposite to each other.

In the above embodiment, as the element constraining the vertical movement of lower guide plate 622, the upper end faces of front and rear walls 63*a* and 63*b* of second cassette 63 are utilized. However, the present invention should not be limited to this, a separate guide element may be provided inside second cassette 63 so as to restrain the vertical movement of lower guide plate 622 by causing the lower end of lower guide plate 622 to abut the upper end of this guide element.

As has been described, according to the present invention, in a paper feeder having a multiple number of paper feed cassettes arranged abreast at approximately the same level in the sheet feed direction, the paper feed cassettes are formed into a unibody structure. Therefore, these cassettes are pulled out together when they are pulled out from the feeder body, thus making it possible to improve the operativity of paper loading task. Particularly, in the configuration where sheet feed is taken over from one cassette to another when the paper in the first paper feed cassette has been used up, sheet loading is usually implemented at the same time for all the paper feed cassettes. Therefore, the configuration of the present invention wherein paper feed cassettes of an identical size are drawn out altogether is markedly effective for the paper feeder of this type.

Further, in the present invention, the feed path for conveying the sheets delivered from the paper feed cassette located on the upstream side with respect to the sheet feed direction is formed over the paper feed cassette located on the downstream side. This feed path is formed by a pair of upper and lower guides plates and adapted to spread by the lower guide plate being lowered in linkage with the paper feed cassettes being pulled out. Therefore, when paper jam has occurred in this feed path the paper can be removed easily, whereby it is possible to improve the operativity.

In the present invention, the pickup units for picking up sheets from the paper cassettes are adapted to be rotated so that they can retract from the top openings. Therefore, this configuration makes the loading of sheets from the top openings of the paper feed cassettes smooth and easy. Further, since the pickup units are adapted to automatically return to their original positions in linkage with the paper feed cassettes being pushed in, this makes it possible for the image forming apparatus to smoothly recover its function after paper loading.

What is claimed is:

1. A paper feeder which is provided for an image forming apparatus having image forming means for forming an image on a sheet and feeds sheets to the image farming means, the paper feeder comprising:

a multiple number of paper feed cassettes arranged abreast at approximately the same level in the sheet feed direction, the paper feed cassettes being formed into a unibody structure so that they can be pulled out altogether from the a feeder body; and a feed oath defined by a pair of upper and lower guide plates formed over the feed cassettes excepting the one located on the most upstream side with respect to the sheet feed direction, for conveying sheets supplied from the paper feed cassettes located on the upstream side of each cassette, wherein the feed path has a gap and is adapted to make the gap wider in response to the paper cassettes being pulled out, so as to allow a sheet stuck therein to be removed therefrom.

2. The paper feeder for use in an image forming apparatus according to claim 1, wherein the upper surfaces of the paper feed cassettes are arranged rising stepwise from the paper feed cassette located on the most downstream side toward the paper feed cassette located on the most upstream side with respect to the sheet feed direction.

3. The paper feeder for use in an image forming apparatus according to claim 1, wherein the feed path is formed by a pair of upper and lower guide plates and the lower guide plate is moved downwards so as to make wider the gap thereof.

4. The paper feeder for use in an image forming apparatus according to claim 3, wherein the level of the upper guide plate is set to be approximately equal to an upper edge of the cassette storage opening of the feeder body when the paper feed cassettes have been pulled out.

5. The paper feeder for use in an image forming apparatus according to claim 3, wherein the lower guide plate is pivotally supported at one end located on the interior side of the feeder body with respect to the direction of the paper feed cassettes being pulled out and the gap of the paper feed path is made wider by rotating the lower guide plate downward about the pivot, and the rotational movement of the lower guide plate is achieved in linkage with the paper feed cassettes being pulled out from the feeder body and being pushed into the feeder body.

6. The paper feeder for use in an image forming apparatus according to claim 3, wherein when the paper feed cassettes have been pushed into the feeder body, the upper surface of the associated paper feed cassette abuts the underside of the lower guide plate so as to position the lower guide plate at a designated level that defines the feed path in cooperation with the upper guide plate.

7. The paper feeder for use in an image forming apparatus according to claim 6, wherein an abutment member that abuts the upper surface of the associated paper feed cassette is provided on the underside of the lower guide plate, and this abutment member has a surface inclined upward in the direction of the paper feed cassettes being pulled out when the lower guide plate is positioned at the designated level that forms the feed path in cooperation with the upper guide plate.

8. The paper feeder for use in an image forming apparatus according to claim 1, wherein each paper feed cassette has a pickup unit for picking up sheets from the paper feed cassette, and this pickup unit is comprised of a pickup roller for picking up one sheet from the paper feed cassette and a pair of feed rollers for delivering the sheet separated by the pickup roller to the image forming means.

9. The paper feeder for use in an image forming apparatus according to claim 8, wherein the pickup unit has bearing plates for supporting the pickup roller and paired feed rollers at their shaft ends in a rotatable manner.

10. The paper feeder for use in an image forming apparatus according to claim 8, wherein the pickup unit is able to pivot on an axis parallel to the axial direction of the pickup roller and paired feed rollers, so that the pickup unit can be moved between a first position where the pickup roller comes in contact with the sheet in the paper feed cassette and a second position where the pickup unit is removed from the top opening of the paper feed cassette.

11. The paper feeder for use in an image forming apparatus according to claim 10, wherein the pickup unit is configured so as to rotate from the second position to the first position in linkage with the paper feed cassettes being pushed into the feeder body.

12. The paper feeder for use in an image forming apparatus according to claim 11, wherein the pickup unit has a projection that abuts a guide element formed on the feeder body and rotates the pickup unit from the second position to the first position when the paper feed cassettes are inserted into the feeder body.

13. The paper feeder for use in an image forming apparatus according to claim 12, wherein the guide element has a surface inclined downward toward the side to which the paper feed cassette is pushed in, and the pickup unit is rotated from the second position to the first position whilst the projection is being guided by the inclined surface.

* * * * *